United States Patent [19]

Akiyama

[11] 4,036,077

[45] July 19, 1977

[54] SAFETY DEVICE FOR LOCKING A PLURALITY OF OPERATION LEVERS

[75] Inventor: Takayuki Akiyama, Sagamihara, Japan

[73] Assignee: Mitsubishi Jukogyo Kabushiki Kaisha, Tokyo, Japan

[21] Appl. No.: 655,952

[22] Filed: Feb. 6, 1976

[30] Foreign Application Priority Data

Mar. 13, 1975 Japan ..... 50-30456

[51] Int. Cl.[2] ..... G05G 5/00

[52] U.S. Cl. ..... 74/526; 74/519

[58] Field of Search ..... 74/519, 523, 526, 529

[56] References Cited

U.S. PATENT DOCUMENTS

| | | | |
|---|---|---|---|
| 2,434,455 | 1/1948 | Cantrell | 74/526 |
| 2,508,023 | 5/1950 | Gustin | 74/529 |
| 2,571,969 | 10/1951 | Vensel | 74/529 X |
| 3,626,780 | 12/1971 | Lowder et al. | 74/526 X |

*Primary Examiner*—Samuel Scott
*Assistant Examiner*—Lance M. Chandler
*Attorney, Agent, or Firm*—Cushman, Darby & Cushman

[57] ABSTRACT

A safety device for locking a plurality of operation levers, the device comprising a frame on which the levers are mounted for pivotal movement with respect thereto, two lock plates mounted side by side on the frame for movement towards and away from one another between locked and unlocked positions of the device in response to rotary movement of a cam disposed therebetween; a respective link pivoted to each of the levers having its free end supported for linear reciprocal movement in response to the pivotal movement of the respective lever, the link having an engaging portion which co-operates with an engaging portion on the respective lock plate on movement of the lock plate towards the locked position to lock the link against the said reciprocal movement.

8 Claims, 8 Drawing Figures

-FIG. 1A.- PRIOR ART
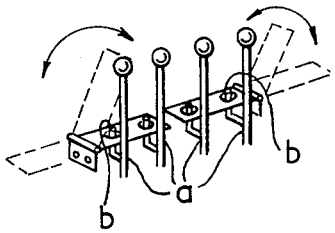
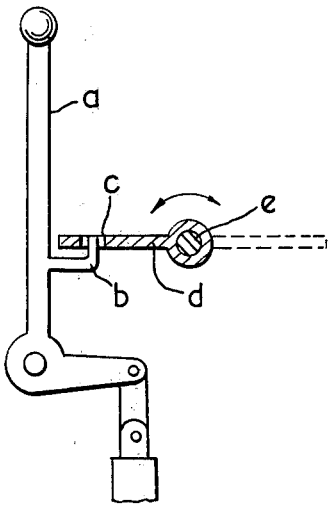
-FIG. 1B.-
PRIOR ART
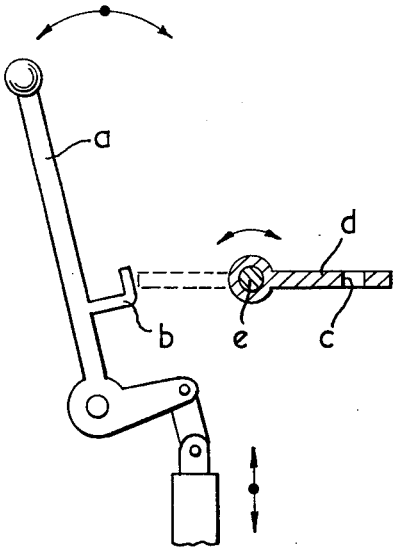
-FIG. 1C.-
PRIOR ART

SAFETY DEVICE FOR LOCKING A PLURALITY OF OPERATION LEVERS

The present invention relates to a safety device for locking simultaneously a plurality of operation levers.

In a construction machine such as a backhoe, various operation levers are mounted for adjustment of the oil pressure and the like. Conventional safety devices for locking these operation levers when the machine is stopped are so constructed that the locking operation is very troublesome. Accordingly, even if a safety device is provided, it is frequently not used for locking.

Such conventional safety devices are shown in FIGS. 1 of the accompanying drawings. FIG. 1A shows a perspective view of one safety device in accordance with the prior art, and FIGS. 1B and 1C are side views of a different safety device, operating on the same principles, in locked and unlocked positions respectively. In these known devices, a projection *b* is formed on each of a plurality of operation levers *a*, Plates *d* having holes *c* for engagement with these projections *b* are disposed so that they can rotate around a shaft *e* (various positions of the plates are shown in dotted lines). Since the number of holes that can be perforated through one plate *d* is limited because of the size of the plate *d*, a plurality of plates *d* should be provided and hence, locking cannot be accomplished by a single operation. Accordingly, even if such a safety device is mounted on a construction machine or the like, it is often not used. Moreover, the engagement between the holes *c* of the plates *d* and the projections *b* of the operation levers is performed by rotating the plates *d*, and therefore, it is very difficult to achieve a good engagement between the holes *c* and projections *b*. For this reason, in the conventional safety device, the hole size is made relatively large as compared with the projection diameter. Accordingly, there is brought about a defect that even if the operation levers are locked by such safety device, each lever moves freely in a vacant space formed between the hole and projection.

In accordance with one aspect of the invention, there is provided a safety device for locking a plurality of operation levers, the device comprising a frame on which the levers are mounted for pivotal movement with respect thereto, two lock plates mounted side by side on the frame for movement towards and away from one another between locked and unlocked positions of the device in response to rotary movement of a cam disposed therebetween; a respective link pivoted to each of the levers having its free end supported for linear reciprocal movement in response to the pivotal movement of the respective lever, the link having an engaging portion which co-operates with an engaging portion on the respective lock plate on movement of the lock plates towards the locked position to lock the link against the said reciprocal movement.

In another aspect the invention provides a safety device for locking a plurality of operation levers, the device comprising a frame on which the levers are mounted for pivotal movement with respect thereto, a lock plate slidably mounted on the frame for movement between a locked and a unlocked position of the device, a respective link pivoted to each of the levers having its free end supported for linear reciprocal movement in response to the pivotal movement of the respective lever, the link having an engaging portion which co-operates with a respective engaging portion on the lock plate on movement of the lock plate towards the locked position to lock the link against the said reciprocal movement, the lock plate being provided with at least one notch to enable the links to reciprocate in the unlocked position of the device.

For a better understanding of the present invention and to show how it may be carried into effect, reference will now be made, by way of example, to FIGS. 2 to 6 of the accompanying drawings, in which:

FIG. 1A is a perspective view illustrating a conventional safety device;

FIGS. 1B and 1C are side views of a different safety device, operating on the same principles, in locked and unlocked positions respectively;

Figure 2:
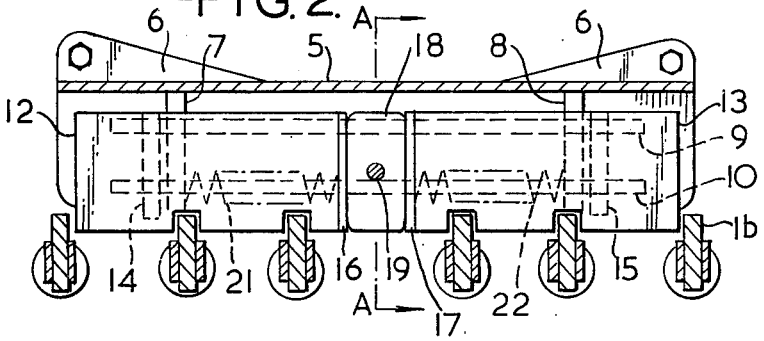
FIG. 2 is a diagram of an embodiment of the safety device of this invention, which shows the section taken along the line B—B in FIG. 3 showing the lever-unlocked state.

FIGS. 2 to 6 illustrate a safety device in accordance with the invention for locking simultaneously six control levers 1 on a construction machine such as a backhoe. The levers 1 are mounted for independent pivotal movement about a shaft 2, which has its ends supported in two end plates 3 of a frame 4 of the device. The frame 4 additionally comprises an upright bracket 5 mounted on a base plate 6 perpendicularly thereto. The bracket 5 and the base plate 6 are held in position by means of brackets 7 and 8 which are secured in an upright position on the base plate 6 and engage the bracket 5. Two parallel rods 9 and 10 pass through respective pairs of holes in the brackets 7 and 8 are fixed thereto to act as guide rods for the sliding movement of two lock plates 12 and 13.

These two lock plates 12 and 13 are mounted side by side on the guide rods 9 and 10 for sliding movement there-along towards and away from one another. The lock plates are mounted on the guide rods 9 and 10 by means of brackets 14 and 15 respectively and operation plates 16 and 17 respectively which are integral with their respective lock plates and which are apertured to receive the guide rods 9 and 10. While the brackets 14 and 15 only project from the lower surface of the lock plates, the operation plates are disposed at one end of their respective lock plate and extend above and below the lock plates perpendicularly thereto. The operation plates 16 and 17 are thereby parallel to one another and form adjacent end plates for the lock plates, between which is operably disposed a cam 18 of rectangular shape with rounded corners. Rotation of the cam 18 about a shaft 19 from the position shown in FIG. 2, in which the longer sides of the cam engage the operation plates, to that shown in FIG. 4, in which the shorter sides of the cam engage the operation plates, causes the lock plates 12 and 13 to move away from one another along the guide rods 9 and 10. The cam is operated by means of a handle 20 (See FIG. 6). When the cam is turned back to the FIG. 2 position the lock plates 12 and 13 are kept in engagement with the cam by means of respective compression springs 21 and 22 mounted on the guide rod 10 one on each side of the cam 18, which act as return springs for the lock plates. The spring 21 has one end bearing against the bracket 7 and the other end bearing against the operation plate 16. The spring 22 is similarly positioned with respect to the bracket 8 and the operating plate 17. The cam 18, the shaft 19 about which it is rotated and the handle 20 are all supported by a bracket 23 fixed to the bracket 5. The shaft 2 passes through the bracket 23 and is supported thereby. The bracket 23 has a cylindrical bore in which the shaft 19 is rotatably supported.

The operation levers 1 each comprise an angled portion 1*a*, one arm of which forms the operation handle, which is pivotable about the shaft 2, and a link 1*b* which is pivoted between the other limb of the angled portion 1*a* and a valve spool 24. The pivotal movement of the lever is thus transferred to a linear reciprocal movement of the valve spool 24. During this reciprocal movement the valve spool 24 moves in and out of a valve body 25.

Each link 1*b* is provided with an engaging extension 26 having a groove 27 extending along the length of the lock plates 12 and 13. The lock plate 12 and 13 are each formed with two notched portions 28 which allow the engaging portions of the link 1*b* to pass downwardly with respect to the lock plates until the groove 27 is positioned in the same plane as the lock plates. Thus as the lock plates are moved by the cam 18 into the position shown in FIG. 4, the edges of the plates 12 and 13 slide in the grooves 27 of the engaging portions 26 until a position is reached in which the links 1*b* can no longer be moved away from the plates 12 and 13. The levers 1 are now locked in position.

In order to facilitate insertion of the lock plates 12 and 13 into the grooves 27 of the engaging portions 26 when the lock plates move away from one another, it is preferred that the upper and lower faces of each groove 27 are tapered in a direction parallel to the movement of the lock plates so as to diverge towards the cam 18.

Figure 3:
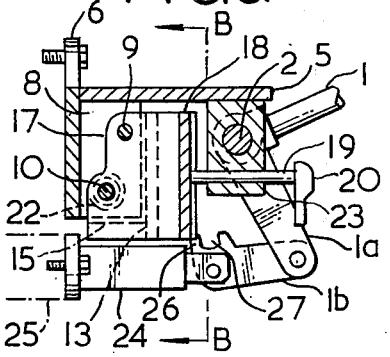
FIG. 3 is a diagram showing the section taken along the line A—A in FIG. 2.

In the lever-unlocked state is shown in FIGS. 2 and 3, the change-over of each valve spool 24 can be made by the pivotal movement of the respective operation lever 1. During this pivotal movement of the operation lever, the engaging portion 26 passes through the notched portion 28 until it is free of the respective lock plate. As is seen from FIG. 2, at this moment the longer sides of the cam 18 are in contact with the operation plates.

The locking of the operation lever 1 is accomplished in the following manner.

Figure 5:
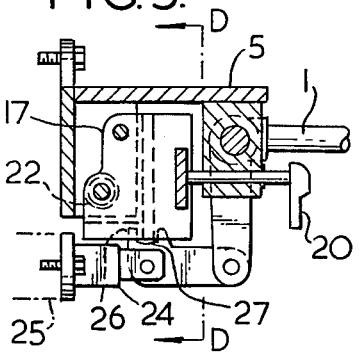
FIG. 5 is a diagram showing the section taken along the line C—C in FIG. 4.
Figure 4:
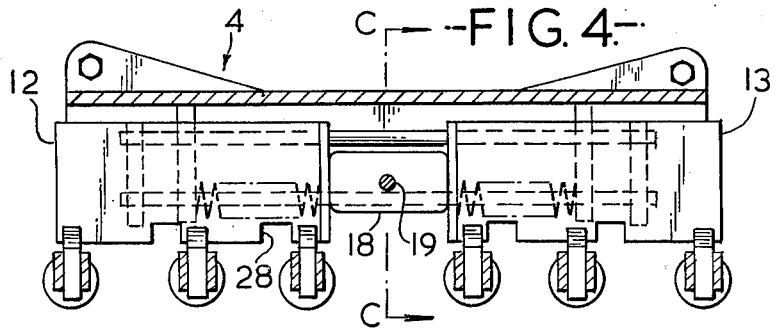
FIG. 4 is a diagram showing the section taken along the line D—D in FIG. 5 showing the same embodiment in the lever-locked state.
Figure 6:
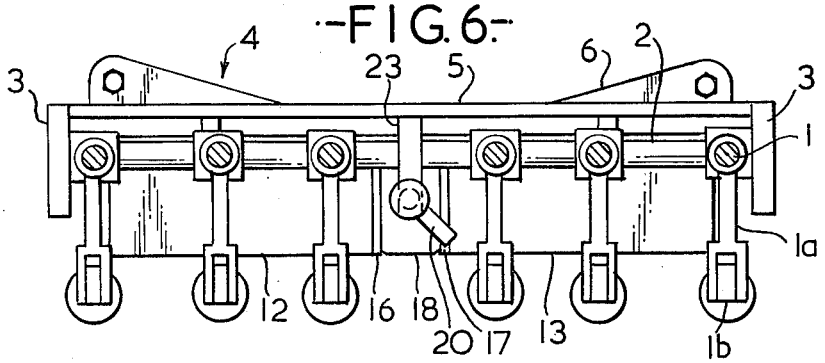
FIG. 6 is a plan view of the embodiment illustrated in FIGS. 2 to 5 partly cut away.

The operation levers 1 are maintained in the vertical state as shown in FIG. 5, and in this state, the cam 18 is rotated by 90° to the position shown in FIG. 4, whereby the lock plates 12 and 13 move away from one another by a distance corresponding to the difference between the longer and shorter sides of the cam 18, and the lock plates 12 and 13 are inserted into the grooves 27 of the engaging members 26. All of the six operation levers 1 are thus locked by one twist of the handle 15. When the handle 15 is rotated again in the same or the opposite direction, the lock plates 12 and 13 move towards one another, whereby the safety device returns to the unlocked state shown in FIG. 2.

It will be appreciated that the engaging portion 26 may engage with the lock plate 12 or 13 by other means, for example by a projection of the engaging portion engaging a groove in the lock plate. Similarly other features such as the shape of the cam, can be altered within the scope of the invention without departing from the appended claims.

What we claim is:

1. A safety device for locking a plurality of operation levers, the device comprising a frame on which the levers are mounted for pivotal movement with respect thereto, two lock plates mounted side by side on the frame for movement towards and away from one another between locked and unlocked positions of the device in response to rotary movement of a cam disposed therebetween; a respective link pivoted to each of the levers having its free end supported for linear reciprocal movement in response to the pivotal movement of the respective lever, the link having an engaging portion which co-operates with an engaging portion on the respective lock plate on movement of the lock plate towards the locked position to lock the link against the said reciprocal movement.

2. A safety device according to claim 1 for locking more than two levers wherein at least one of the lock plates has one or more notches to enable the links to reciprocate in the unlocked position of the device.

3. A safety device according to claim 1 wherein the device comprises a frame on which the levers are mounted for pivotal movement with respect thereto, a lock plate slidably mounted on the frame for movement between a locked and an unlocked position of the device, a respective link pivoted to each of the levers having its free end supported for linear reciprocal movement in response to the pivotal movement of the respective lever, the link having an engaging portion which co-operates with a respective engaging portion on the lock plate on movement of the lock plate towards the locked position to lock the link against the said reciprocal movement, the lock plate being provided with at least one notch to enable the links to reciprocate in the unlocked position of the device.

4. A device according to claim 2 for locking six levers, wherein each of the plates has two such notches.

5. A device according to claim 1, wherein the engaging portion on each link is a groove and that on the lock plate is the edge of the lock plate, the edge of the lock plate engaging in the said groove to lock the device.

6. A device according to claim 5, wherein the opposite faces of the groove of each engaging member taper in a direction parallel to the movement of the lock plates diverging towards the cam.

7. A device according to claim 1, wherein the lock plate is mounted on the frame by means of two parallel guide rods which pass through respective apertures in brackets integral therewith and is resiliently biased into one of its positions by means of a resilient bias operatively mounted between an end plate integral with the lock plate and the frame.

8. A device according to claim 7, wherein the end plate additionally serves as one of the said brackets.

* * * * *